United States Patent [19]

Hicks

[11] Patent Number: 5,003,216

[45] Date of Patent: Mar. 26, 1991

[54] ELECTRON AMPLIFIER AND METHOD OF MANUFACTURE THEREFOR

[75] Inventor: John W. Hicks, Northboro, Mass.

[73] Assignee: Hickstech Corp., New York, N.Y.

[21] Appl. No.: 365,335

[22] Filed: Jun. 12, 1989

[51] Int. Cl.[5] ..... H01J 1/30; H01J 1/46; H01J 9/02

[52] U.S. Cl. ..... 313/306; 313/309; 313/336; 445/23

[58] Field of Search ..... 313/306, 309, 336, 355; 445/23

[56] References Cited

U.S. PATENT DOCUMENTS

| | | | |
|---|---|---|---|
| 4,596,942 | 6/1986 | Oshima et al. | 313/336 X |
| 4,721,885 | 1/1988 | Brodie | 313/336 X |
| 4,827,177 | 5/1989 | Lee et al. | 313/336 X |
| 4,855,636 | 8/1989 | Busta et al. | 313/336 X |

*Primary Examiner*—Sandra L. O'Shea
*Attorney, Agent, or Firm*—Stanley J. Yavner

[57] ABSTRACT

A novel vacuum tube type of electric apparatus preferably utilizes cold cathode emission to provide an electron source. A grid element is employed to vary path direction for the particles, which are directed to alternative positions of an anode element. Secondary electron emission from a portion of the anode is utilized to permit the anode potential to rise upon electron impingement, while a second portion of the anode retains electrons to drive the anode potential in the negative sense. The structure allows both positive and negative states to be maintained, and has value in both rapid switching and memory application. The tube is advantageous manufactured on an insulating substrate which may be drawn to microscopic dimensions. This permits a dense pack to be accomplished, with low power requirements and high operating speed.

26 Claims, 4 Drawing Sheets

ELECTRON AMPLIFIER AND METHOD OF MANUFACTURE THEREFOR

The present invention relates to the electronic arts, and, in particular, to amplifier devices of the vacuum tube varieties which can be manufactured in a microscopic scale. The devices of the present invention are characterized by low power needs and high speed and may be formed in an integrated circuit manner.

BACKGROUND OF THE INVENTION

Vacuum tubes such as diodes, triodes and tetrodes, normally operating on the principle of thermal electron emission, began a fall from favor with the discovery and implementation of semiconductor technology as exemplified by the transistor. Compared to their semiconductor counterparts, vacuum tubes had several limitations, including the likelihood of failure of the incandescent cathode due to thermal stress. In addition, as a result of the relatively large spacial distances employed, the tubes were also relatively slow. Such distances also required a relatively high vacuum to insure that an emitted electron would not encounter a residual atom or molecule in its travel to the tube anode. Lastly, the physical sizes of such tubes, along with their power requirements and heat dissipation, put severe limitation on their use in largescale switching or memory applications.

It is accordingly an object of the present invention to provide a new and improved version of a vacuum tube which has a cathode element which is not operated at elevated temperatures.

Yet another object of the present invention is to provide such a vacuum tube having a reduced geometric scale, allowing for providing improved response time and for greater packing.

Yet another purpose of the present invention is to provide an improved vacuum tube which may be constructed using advanced drawing and deposition techniques, allowing the tube to be formed at reduced expense and in a repetitive layout, allowing large-scale integrated circuits of such tubes to be created.

BRIEF DESCRIPTION OF THE INVENTION

In accordance with the above and other objects and purposes, the present invention utilizes a control or grid element to modulate the direction of an electron beam, emanating from the tube cathode, rather than its magnitude or current, to control anode potential and current flow. In particular, a preferred embodiment of the invention utilizes a multiple portion anode element having differing electron emissivity characteristics for the portions. An electron beam produced by a cold cathode is directed between the anode portions by a control element or grid, whose potential is varied to change the path of the beam. The control element is located adjacent the beam path, rather than within the beam path as in conventional vacuum tubes.

The device of the present invention is preferentially manufactured and constructed from a preform originally of macroscopic dimensions, which is drawn to a reduced scale. The preform may be composed of a plurality of insulating elements, such as glasses, assembled as required. In order to obtain the desired structure, one of the glasses is made etchable or otherwise removable compared to the other. After the preform is drawn down to the appropriate size, it is etched, the etchable glass being removed to yield the desired construction. Electrode areas may then be applied to the resulting substrate, such as by evaporation techniques, to provide the appropriate electrode surfaces. The device is then sealed in an appropriate vacuum environment. The structure for a tube may be repeated along the length and width of the substrate to yield a matrix of tube elements in the form of an integrated circuit assembly.

BRIEF DESCRIPTION OF THE DRAWINGS

A fuller understanding of the present invention and the objects and features, will be accomplished upon consideration of the subsequent detailed description of preferred, but nonetheless illustrative embodiments of the invention when taken in conjunction with the annexed drawings, wherein.

DESCRIPTION OF PREFERRED EMBODIMENTS

Figure 1:
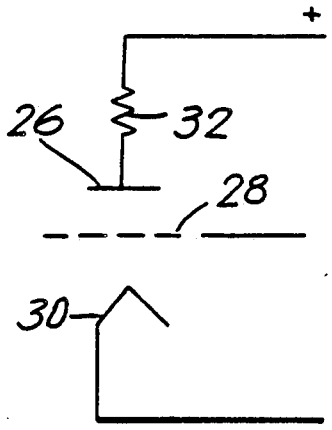
FIG. 1 is a schematic representation of a vacuum tube of the prior art.

As seen in FIG. 1, a conventional vacuum tube triode has a heated cathode 30 and an anode 26 separated by a control grid 28. The grid 28 is normally perforated to allow the thermal electrons from the cathode to be attracted by the positive potential anode 26. The potential of the grid is varied to control the electron density or current through the device.

Figure 2:
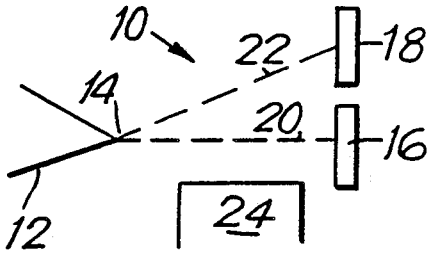
FIG. 2 is a diagrammatic representation of a triode vacuum tube of the present invention having a pair of discrete anodes.

In a preferred embodiment of the invention, field emission from a metal surface cathode, rather than thermal emission, is utilized in conjunction with an anode and control grid structure. As seen in FIG. 2, triode assembly 10 includes the cathode 12 designed with a sharp edge 14 adapted to enhance the emission of electrons from the cathode and concentrate such emission along the edge as known in the art. First and second anodes 16 and 18, respectively are positioned to receive the electrons traveling along alternative paths 20 and 22. A control grid 24 is located between the cathode and anodes, displaced from the paths 20, 22 of the electrons, but so located as to have an effect thereon when properly biased. In particular, the emitted electrons tend to travel along path 20 when grid 24 is relatively more positive, and along path 22 when the grid is biased more negatively. Because the grid 24 is not directly in the path of the electrons, electron transparency is not a concern, and the grid can be formed on the needed microscopic scale without great difficulty. The potential of anode 16 is sensed by appropriate circuitry to utilize the varying potential based upon the electron beam shift. Ordinarily, second anode 18 serves only as a depository for the electrons of the shifted beam.

The inventive structure of FIG. 2 allows a lesser voltage change on the grid 24 to effect a given current change at the anodes than would be required in conventional geometry of FIG. 1 in which the grid assembly is physically positioned between the cathode and anode elements within the path of electron flow. In addition, the structure of FIG. 2 can be made on a substantially reduced dimensional scale as compared to conventional geometry. A potential difference of 4 to 10 volts is all that is required, the grid being only negative enough to cause the path deviation and to prevent electron attraction and collection by it.

In triodes using conventional structures, as depicted in FIG. 1, the flow of electrons from cathode 30 to anode 26 always drives the anode in a negative potential sense. In order to maintain the anode at a positive potential during operation, a second continuous current path to the anode must be provided, normally through a biasing resistor 32. For the device to have a short response time, necessary for fast switching, the resistance 32 must be low, but high sensitivity to grid voltage changes requires that the resistance be high. In conventional vacuum tube circuitry these two conflicting requirements require compromise in the overall design of the circuitry and prevent high speed, high sensitivity devices from functioning reliably.

Figure 3:
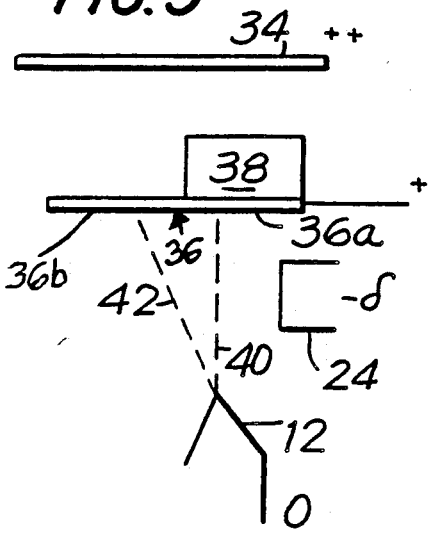
FIG. 3 is a representation of a triode vacuum tube of the present invention utilizing a unitary, multiple section anode.

The present invention, however, can allow for the anode to be driven and remain either more positive or negative without the necessity for a second path for a biasing potential. This is accomplished by the use of a multiple part anode structure. As depicted in FIG. 3, the unitary first anode structure 36 is formed of a thin film conductor partially overlying and extending beyond the substrate 38. A second, drone anode 34 is provided behind and parallel to the anode 36. In particular, a thin film of aluminum or other metal has a first portion **36*a* deposited or otherwise bonded to insulating substrate 38. When the electrons travel along path 40 they impact upon and are retained by the anode portion 36*a*, driving the anode in a negative sense. When the electrons follow path 42, however, due to the application of more negative potential to the grid 24, they impinge upon the free portion 36*b* of the anode, penetrating into the anode and knocking out secondary electrons which are directed towards positively-charged drone anode 34**. This secondary emission exceeds the gain of electrons by the anode due to cathode emission, resulting in a net loss of electrons, driving the anode in a more positive sense. This ability to drive the anode either negative or positive allows the triode to be maintained in either of two alternative stable states, without drawing additional power in either state. This permits both switching and memory (charge storage) functions to be carried out efficiently.

Appropriate circuitry operatively connected to the anode can thus be utilized to respond to both the positive and negative fluctuations. In addition, the device may serve as a low-power memory device as the positive and negative-going variations can both be maintained without large amounts of biasing current In general, the anode 36 needs to be only 1 to 5 volts positive with respect to cathode 12, with drone anode 34 being roughly 1 to 5 volts positive with respect to anode 36.

Figure 4:
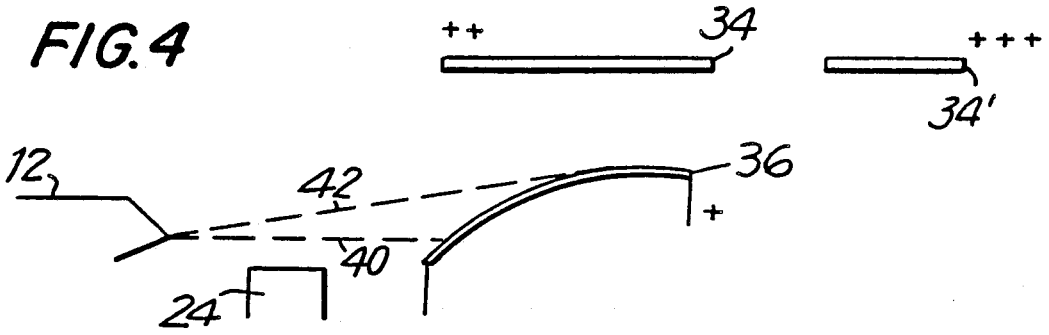
FIG. 4 is a representation of an alternative form of triode of the present invention.

An alternative embodiment of the structure of FIG. 3 is presented in FIG. 4. In that embodiment the anode 36 is provided in a curved form, with the path of the electrons emitted by the cathode 12 being controlled by grid 24 to vary the angle at which they strike the anode. When the electrons travel along first path 40, they impinge more or less perpendicular to the anode, remaining in the anode and driving it in the negative sense. The thickness of the anode and its substrate tend to retain the secondary emission electrons within the anode.

When the emitted electrons strike at an oblique angle, however, along path 42, the secondary electrons are emitted generally parallel to the surface, away from the impinging beam, and thus have the ability to escape from the anode. Again, there is a net loss of electrons, resulting in the anode being driven more positive. A second drone anode 34' may be provided to enhance the likelihood of escape of the secondary electrons and provide a final resting place for the secondary electrons.

The structures described above are preferably intended to be utilized on a microscopic scale, to allow large-scale arrays of the devices to be constructed. In an especially preferred embodiment, the devices are formed with the use of glass as a vitreous, drawable material for a substrate. Other materials having similar characteristics may be similarly utilized, with the requirement that the substrate is electrically equivalent as an insulator to glass.

Figure 5:
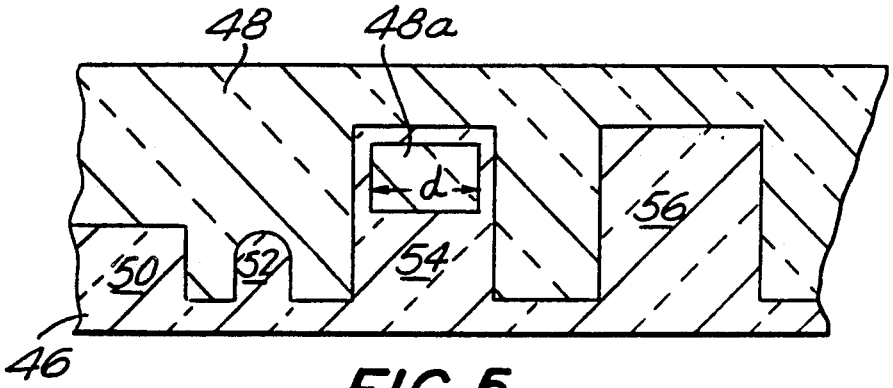
FIGS. 5–9 are representations of successive steps in the manufacture of a triode of the type of FIG. 3.

As seen in FIG. 5, manufacture of the device begins with the construction of a preform composed of two differing glass element portions 46 and 48, **48*a*, portion being substantially more resistant to an etching process than element 48. The portion 46 is intended to be the ultimate substrate for the resulting device, with pedestal portion 50, 52, 54 and 56 defining the location for the device cathode, grid, anode and drone anode of the configuration of FIG. 3, respectively. The grid pedestal 52** may preferably have arcuate top surface.

The preform may be machined from blocks of appropriate glass on a relatively large scale and then drawn down to a microscopic size. For example, the dimension "d" may be of a scale of $\frac{1}{4}$ inch in the preform, drawn down to five microns or less. A typical glass for the etch-resistant portion 46 may have a silica base, with silica constituting at least 80% of the composition by weight. The etchable glass portion 48 may have both boron ($B_2O_3$) and silicon ($SiO_2$) as glass formers, with silica constituting less than 60% by weight. Such etchable glasses, etchable by dilute acetic acid, are known in the art. Schott glass LaK-3 is representative.

Figure 6:
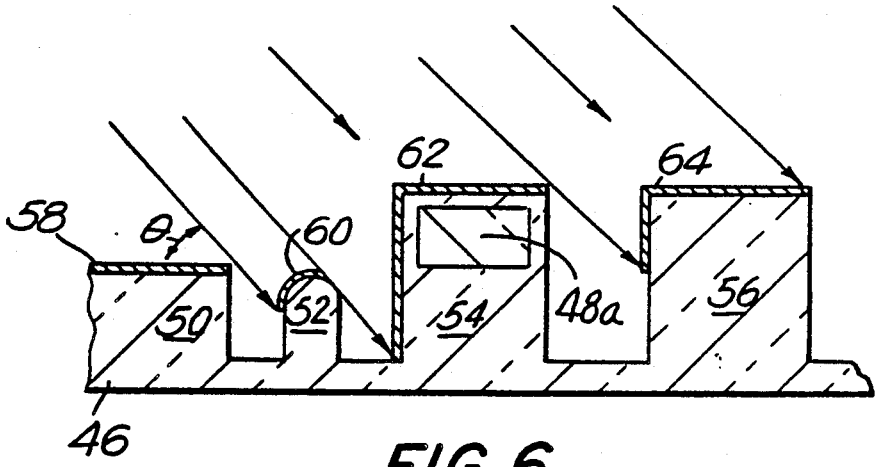

After the glass is drawn the portion 48 is removed by the etching process. A metallic coating, such as aluminum, is then deposited, as depicted in FIG. 6, such as by evaporative techniques known in the art, at an angle $\theta$ chosen to cover portions of the electrode-defining substrate portions 50–56 as depicted. The relative sizing of the portions 50–56 of the substrate glass 46, as well as the angle $\theta$ for deposition, are chosen and adjusted as required to provide the appropriate coating locations as shown. In particular, the coating application process applies a surface 58 to the top of substrate pedestal 50, a grid-forming surface 60 on the left portion of the arcuate pedestal 52, an anode-forming surface 62 on the left side and top surfaces of pedestal 54, and a drone anode-forming surface 64 on the top and upper portion of the left side surface of pedestal 56.

Figure 7:
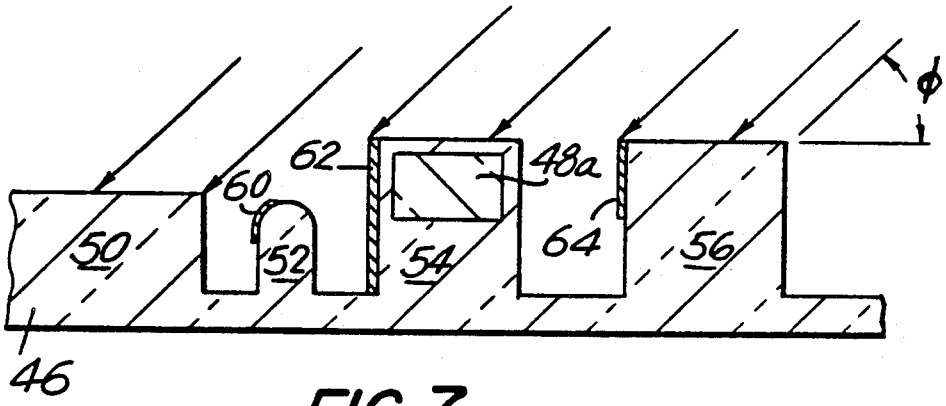

After deposition, portions of the aluminum coating are selectively removed, such as by ion beam etching impinging upon the structure at an angle $\phi$, to produce the structure shown in FIG. 7. In particular, this step removes the coating from the top surfaces of the pedestals, leaving a portion of grid 60 and the vertical portions of anode 62 and drone anode 64.

Figure 8:
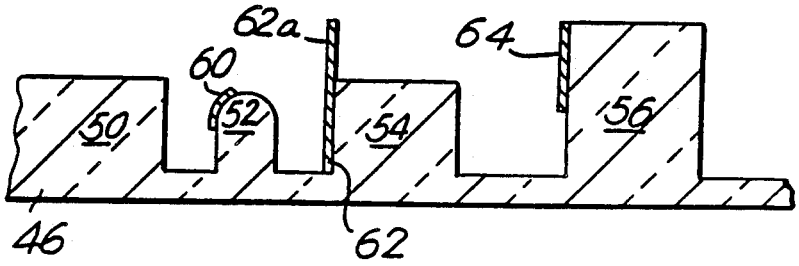

A short etching in hydrochloric acid removes the thin layer of resistant glass 46 surrounding etchable glass 48*a* which is then etched away by acetic acid, leaving the structure of FIG. 8. This creates the free-standing portion 62*a* of the anode 62. The pedestal surfaces are aluminized at the same angle $\theta$ as the first deposition of FIG. 6, creating the structure of FIG. 9, wherein cathode element 66 is recreated with a sharp edge 68 for electron emission, a full grid coating 60 is established, coating 62 is the anode, and coating 64, reformed along the top surface of pedestal 56, as well as along the top portion of its left side, is the second or drone anode. As may be recognized, this final structure may be reproduced along the x axis as many times as required.

Figure 10:
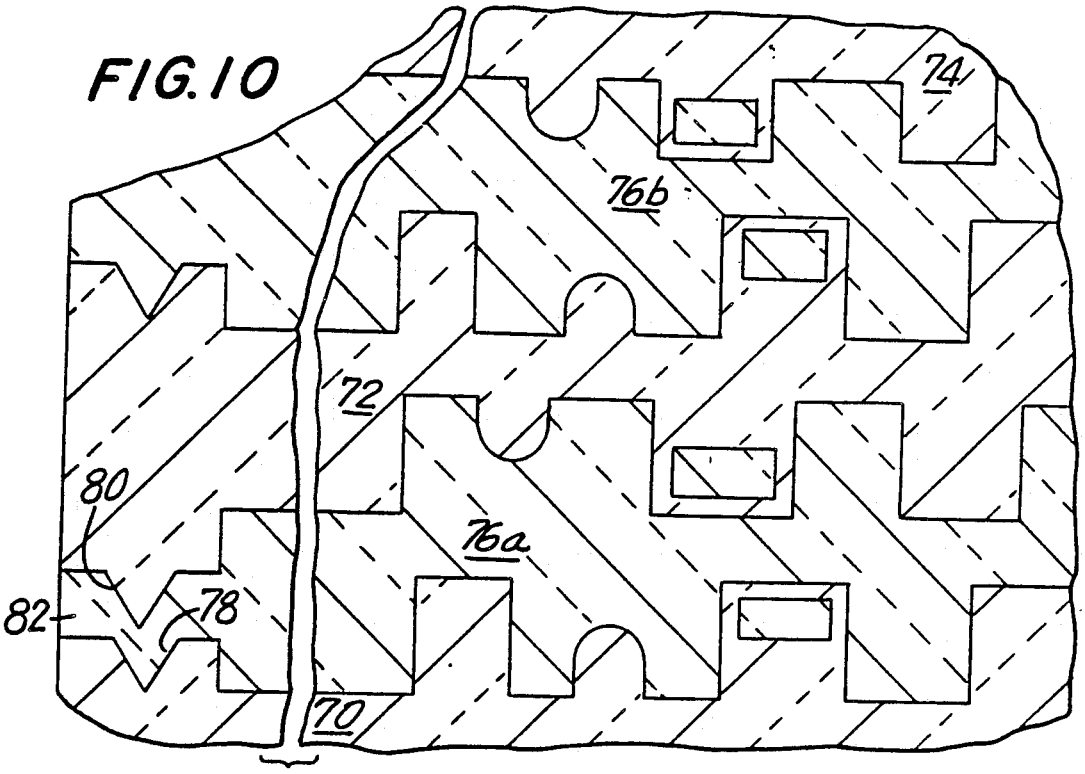
FIG. 10 is a representation of a multiple layer embodiment, suitable for large-scale integrated circuit production.

To create a three-dimensional array, additional layers in the z axis may be formed, as shown in FIG. 10. As shown therein, layers 70, 72 and 74 of resistant glass are sandwiched with etchable glass layers 76*a*, 76*b*, etc., to create a three-dimensional matrix of tube elements. At the edges of the preform, an indexing means, such as a mating V-groove 78 and projection 80 in the adjacent resist glass layers are provided, with an intermediate portion 82 of the etchable glass being provided to allow etchant to enter the spaces between the resistant glasses. When the etch is completed, the resist glass portions are separated for further processing, then reassembled into a multi-layer composite by use of the indexing means. Both resist layers 70 and 72, for example, may thus include electrode elements in the same cavity, the elements on glass portion 70 being on its top surface, the elements on glass portion 72 being on its bottom surface. This allows a dense pack to be accomplished.

In conventional vacuum tubes, the relatively large distances that the electrons must traverse require a relatively high vacuum to provide an appropriately long, mean-free path length, the measure of the average distance an electron can travel without striking a residual gas molecule. In the present invention, however, the distances employed are in the order of 1 to 10 microns. This requires a mean-free path as short as one one thousandth of a centimeter, thus allowing for a very low-level vacuum, which permits a glue seal between the elements to be utilized.

Figure 9:
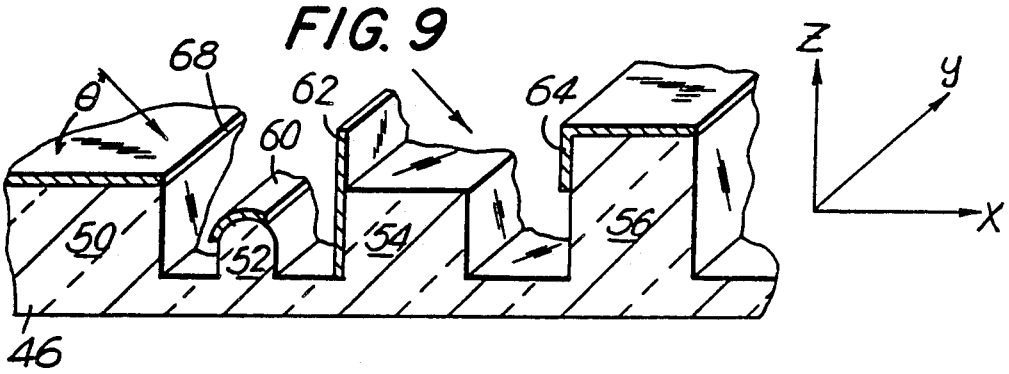

It can be appreciated that the electrode length extending in the Y direction in FIG. 9 may be divided by ion etching, photolithography, laser beam ablation, or mechanical scraping to provide a plurality of elements. The various electrodes on one layer can be electrically connected to electrodes on an opposing layer surface by field emission or inter-electrode capacitance. Such means of interconnection allow flexibility in designing integrated circuits using the technology of the present invention.

Figure 11:
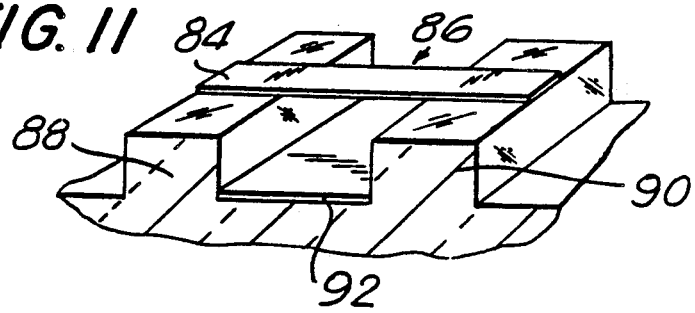
FIG. 11 is a representation of a method of interconnection which may be utilized between elements.

In addition, by the use of suitable techniques, such as photolithography, a metalized area can be applied to the preform before the etching process to provide an electrical "bridge" between adjacent elements This is depicted in FIG. 11, wherein the metallic surface 84 bridges the depression 86 formed by the removal of etchable glass therefrom, connecting the elements formed upon the surfaces of resistant glass pedestal portions 88 and 90. By the use of evaporative deposition techniques focused at an angle, a conductive coating may be applied to the bottom of the depression 86 to provide for a continuous electrode 92 under the metallic bridge 84.

Figure 12:
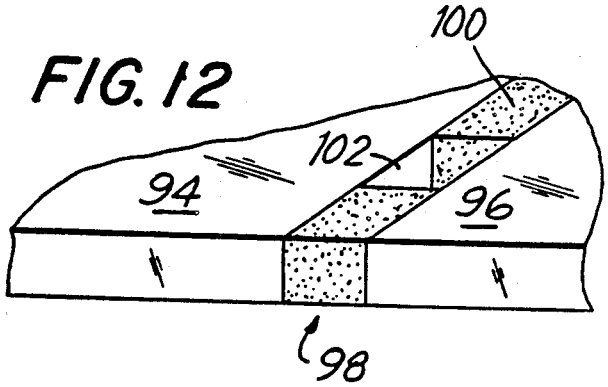
FIG. 12 is a representation of a method of interconnection between substrate surfaces utilizing a "tunnel" through the substrate.

Connections can also be made between opposite sides of the same etch-resistant substrate layer. As shown in FIG. 12, portions 94 and 96 of the substrate may be separated by an etchable glass portion 98. The exposed surfaces of the block 98 are covered with an appropriate etch resist 100, such as a photoresist solution, except for the location 102 at which the through-connection is desired. Etchant is then applied, creating a tunnel through the block. The tunnel is then filled by a conductive paste, such as a metal-filled resin or conductive paint, to create a conductive path between the top and bottom surfaces. The photoresist can then be removed and the remaining portion of the etchable block 98 removed as may be required. While resins and the like often contaminate high vacuums, at the pressures required by the present invention, such contamination is not a problem.

Figure 13:
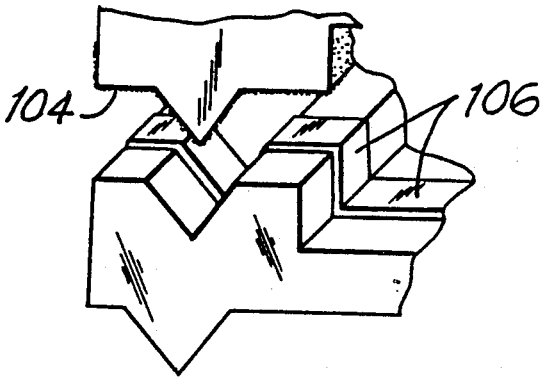
FIG. 13 is a representation of a method of interconnection between substrate surfaces utilizing a conductive band about the substrate edge.

Another method of electrically interconnecting opposed surfaces is to provide a conductive "stripe" about the edge of the device Using appropriate deposition and resist combinations, a stripe may be applied. This can be advantageously utilized, as shown in FIG. 13, across the alignment edges, the glue bond 104 joining the substrates being able to accommodate the small differences in thickness produced by the deposition process creating the conductor 106 and creating the necessary seal between the layers.

Arrays formed using the technology of the present invention are preferentially made as elongated devices having anywhere from 50 to 500 elements across a width of anywhere from 0.01 to 0.05 inches. Since the device is drawn, it can be made in any desired length. In general, cost considerations are reflected by the width of a drawn device, rather than its length. With a switching speed of $10^{-12}$ seconds, a signal travels approximately 200 microns or approximately 0.008 inches. Thus, a limitation of width to between 0.01 and 0.05 inches is not a severe impediment. Similarly, the use of a wrap path about the edge of the device, as shown in FIG. 13, will not cause significant signal delays, although the "tunnel" path, being more direct, is faster.

Figure 14:
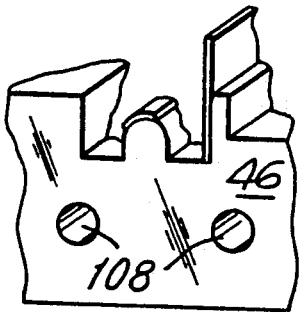
FIG. 14 is a representation of an integrated circuit configuration including cooling channels in the substrates.

At high component densities and high operating speeds heat dissipation becomes a concern. The construction of the present invention, utilizing glass and metal, rather than semiconductor elements, has the inherent advantage of being less sensitive to elevated temperatures and accordingly more able to dissipate heat. In a multi-layer stack device, cooling channels 108 can be incorporated within the substrate, as shown in FIG. 14 to improve heat dissipation. Such channels may be formed by the removal of an etchable glass or by other appropriate means as may be known in the art.

In general, a switching time of $10^{-12}$ seconds represents a reasonable upper speed limit, with a maximum element packing at about 2500 per square centimeter. If a 10 micron electron transit dimension is utilized, other dimensions (center-to-center spacing) must be on the order of 250 microns for power dissipation. Photolithography has sufficient spatial resolution for such dimensions.

I claim:

1. A vacuum tube comprising an electron emitting sharp edge cathode, an anode separated from said cathode and adapted to receive electrons emitted therefrom along a plurality of paths, a grid located between said cathode and anode adjacent to, but not in the path of, the emitted electrons electrically biased to direct said electrons among said plurality of paths said anode and grid being of a certain magnitude of dimensions and said sharp edge cathode being comparable in size to said dimensions.

2. The vacuum tube of claim 1, wherein said cathode is a field emission element.

3. The vacuum tube of claim 2, wherein said cathode anode and grid each comprise conductive surfaces applied to portions of a unitary insulating substrate.

4. The tube of claim 3, wherein said substrate is glass.

5. A vacuum tube comprising an insulating substrate having a first raised pedestal electron-emitting cathode-forming portion, a second raised pedestal grid-forming portion, and third and fourth raised pedestal anode-forming portions for receipt of electrons emitted by said cathode-forming portion, said grid pedestal being positioned between said cathode-forming portion and anode-forming portions adjacent the path of electron travel, said grid adapted to modulate the path of electron travel between said third and fourth raised pedestal anode-forming portions, said pedestals being located in a low vacuum environment.

6. The tube of claim 5, wherein said third anode-forming portion supports first and second sections having differing electron adherence characteristics.

7. The tube of claim 6, wherein said third raised pedestal anode-forming portion comprises a first section backed by said third pedestal and a second free-standing section.

8. The tube of claim 7, wherein said cathode-forming portion, grid and anode pedestals each bear a conductive surface formed by a deposition process.

9. The tube of claim 8, wherein said cathode-forming portion is formed with a sharp edge for directed electron emission towards said anode.

10. A method for the manufacture of a vacuum tube having cathode, grid and first and second anode electrodes formed from an insulating substrate, comprising the steps of forming a macroscopic preform out of a pair of insulating materials, the first of said insulating materials defining the tube substrate and the second of said insulating materials forming a top substrate over said first insulating material being preferentially removable with respect to said first material, said first insulating material including pedestal portions defining said electrode locations; drawing said preform down to a desired microscopic scale; selectively removing said second insulating material to expose said substrate in the desired form and depositing on said pedestal portions conductive coatings to form the electrode structures upon said pedestals and conductive paths thereto; and sealing said electrode structures within a common vacuum having an electron mean-free path length no less than the distance between said anode and cathode elements.

11. The method of claim 10, wherein said selection removal and deposition step comprise the further steps of removing said second insulating material to expose said pedestals; evaporating a conductor onto said pedestals at a first angle to cover the tops of said cathode, grid and anode pedestals, a portion of one side of each of said grid and second anode pedestals and one full side of said first anode pedestal; removing the conductor from the tops of said cathode and anode pedestals; removing substrate and remaining second insulating material to create a free-standing electron portion from the evaporated conductor on the side of said first anode pedestal, and redepositing a conductor at said first angle to recover the top of said cathode grid and second anode pedestal.

12. A memory element comprising an electron emitter, a grid for controlling the direction of travel of the electrons emitted therefrom and an anode target, said target having a plurality of electron reception areas each having a different electron receptivity, said grid being adapted to control the direction of said electrons to said target areas.

13. The memory of claim 12, wherein said anode target has positive and negative going target areas.

14. The memory element of claim 12, wherein said anode includes a first pedestal portion adapted to receive electrons emitted by said cathode and a second pedestal portion displaced from said first portion and on the opposite side of said first portion from said cathode.

15. The memory element of claim 14, wherein said first anode portion includes both positive and negative driven sections.

16. The memory element of claim 14, in which said negative-going section is formed of a metallic coating applied to said first pedestal portion.

17. The device of claim 15, in which said positive-going section comprises a free-standing conductive electrode element extending from said first pedestal portion.

18. The device of claim 16, wherein said first anode pedestal portion is approximately 5 microns in length.

19. A switchable charge storage device, comprising an electrode source of charged particles a charge-retaining electrode spaced from said source adapted to receive said charged particles and comprising first and second portions, said first portion acquiring a net positive charge and said second portion acquiring a net negative charge upon receipt of said charged particle; and a grid electrode located to control the direction of travel of said charged particles between said source and first and second electrode portions.

20. The device of claim 19 wherein said source is an electron emission device.

21. The device of claim 20 wherein said emission device is of the cold field emission variety.

22. The device of claim 19 wherein said grid controls the direction by variation of the electric potential applied to said grid.

23. The device of claim 20 wherein said first portion of said charge-retaining electrode comprises a secondary electron emission device.

24. The device of claim 23 wherein said secondary electron emission device comprises a thin film conductive element supported within a vacuum.

25. The device of claim 23 wherein said secondary electron emission device comprises a conductor positioned to receive said electrons from said source at an oblique angle.

26. The device of claim 23 wherein said secondary electron emission device comprises a primary electrode and a secondary electrode spaced therefrom to receive secondary electrons emitted from said primary electrode.

* * * * *